US005289086A

United States Patent [19]

Kane

[11] Patent Number: 5,289,086

[45] Date of Patent: Feb. 22, 1994

[54] ELECTRON DEVICE EMPLOYING A DIAMOND FILM ELECTRON SOURCE

[75] Inventor: Robert C. Kane, Scottsdale, Ariz.

[73] Assignee: Motorola, Inc., Schaumburg, Ill.

[21] Appl. No.: 877,931

[22] Filed: May 4, 1992

[51] Int. Cl.[5] ..... H01J 1/46; H05B 41/00

[52] U.S. Cl. ..... 315/349; 313/308; 313/311

[58] Field of Search ..... 315/167, 169.3, 169.4, 315/324, 326, 334, 349; 313/308, 310, 311, 336

[56] References Cited

U.S. PATENT DOCUMENTS 5,138,237 8/1992 Kane et al. ..... 315/349

5,180,951 1/1993 Dworsky et al. ..... 315/169.3

*Primary Examiner*—Tony M. Argenbright

*Attorney, Agent, or Firm*—Eugene A. Parsons

[57] ABSTRACT

An electron device including a diamond material electron emitter and an anode, both disposed on a supporting substrate, so as to define an interelectrode region therebetween. Electron transport across the interelectrode region is initiated at an emitting surface of the diamond material electron emitter. An alternative embodiment employs a gate electrode disposed substantially symmetrically and axially displaced about the electron emitter and substantially in the interelectrode region to provide a modulation capability.

14 Claims, 3 Drawing Sheets

ELECTRON DEVICE EMPLOYING A DIAMOND FILM ELECTRON SOURCE

FIELD OF THE INVENTION

This invention relates generally to electron devices and more particularly to electron devices employing diamond material as an electron source.

BACKGROUND OF THE INVENTION

Electron devices employing ballistic transport of electrons are known in the art. However, known prior art devices suffer from a number of shortcomings. Prior art vacuum tube devices are large and not integrable. Recently developed field emission electron devices require very high electric fields and very small features on the order of a few hundreds of angstroms to achieve the very high electric fields. Planar field emission electron devices, known in the art, require sub-micron (less than 0.05 micron) electrode feature sizes to enable device operation.

Accordingly there exists a need for an electron device which overcomes at least some of the shortcomings of the prior art.

SUMMARY OF THE INVENTION

This need and others are substantially met through provision of an electron device including a supporting substrate having a major surface; and a diamond material electron emitter having an emitting surface, for emitting electrons, disposed on a part of the major surface; and an anode, for collecting at least some of any emitted electrons disposed on a part of the major surface and distally with respect to the emitting surface of the diamond material electron emitter and defining an interelectrode region therebetween.

This need and others are further met through provision of an electron device comprised of: a supporting substrate having a major surface; and a diamond material electron emitter having an emitting surface, for emitting electrons, disposed on a part of the major surface; and an anode, for collecting at least some of any emitted electrons disposed on a part of the major surface and distally with respect to the emitting surface of the diamond material electron emitter and defining an interelectrode region therebetween; and a gate electrode disposed on a part of the major surface and substantially symmetrically and axially displaced about the electron emitter and substantially in the interelectrode region.

DETAILED DESCRIPTION OF THE DRAWINGS

Figure 1:
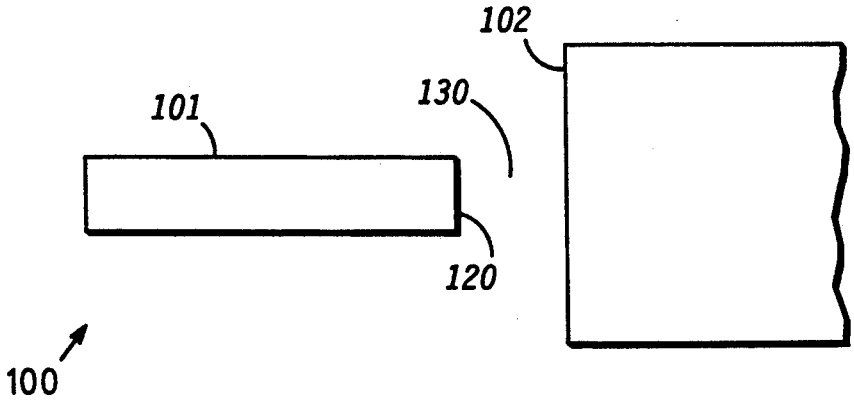
FIG. 1 is a partial top plan view depiction of an embodiment of an electron device in accordance with the present invention.

FIG. 1 is a partial top plan view of an embodiment of an electron device 100 in accordance with the present invention. Device 100 includes a diamond material electron emitter 101 having an emitting surface 120, for emitting electrons, and an anode 102, for collecting at least some of any emitted electrons, distally disposed with respect to each other and defining an interelectrode region 130 therebetween.

Figure 2:
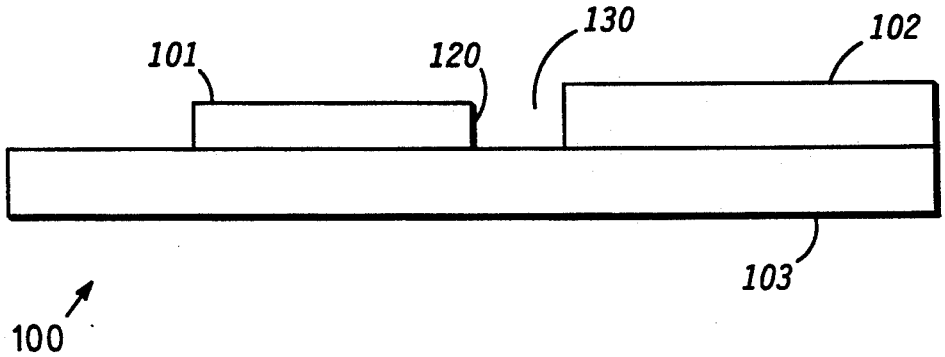
FIG. 2 is a side elevational cross sectional representation of the electron device in FIG. 1.

FIG. 2 is a side elevational cross sectional representation of device 100 and further depicting a supporting substrate 103. Both the diamond material electron emitter 101 and the anode 102 are each disposed on a part of a major surface of the supporting substrate 103 to effect a substantially co-planar orientation.

It is noted that diamond material electron emitters may generally be realized by deposition of diamond material onto a suitable substrate as is commonly known in the art. One such deposition technique employs a chemical vapor deposition process. Some deposition methods desirably provide substantially single crystal diamond material films. Other deposition methods may provide polycrystalline diamond material films. In some embodiments of the present invention, to be described subsequently, it is desirable to provide substantially single crystal diamond material electron emitters. Other embodiments may satisfactorily employ polycrystalline diamond material electron emitters.

Figure 3:
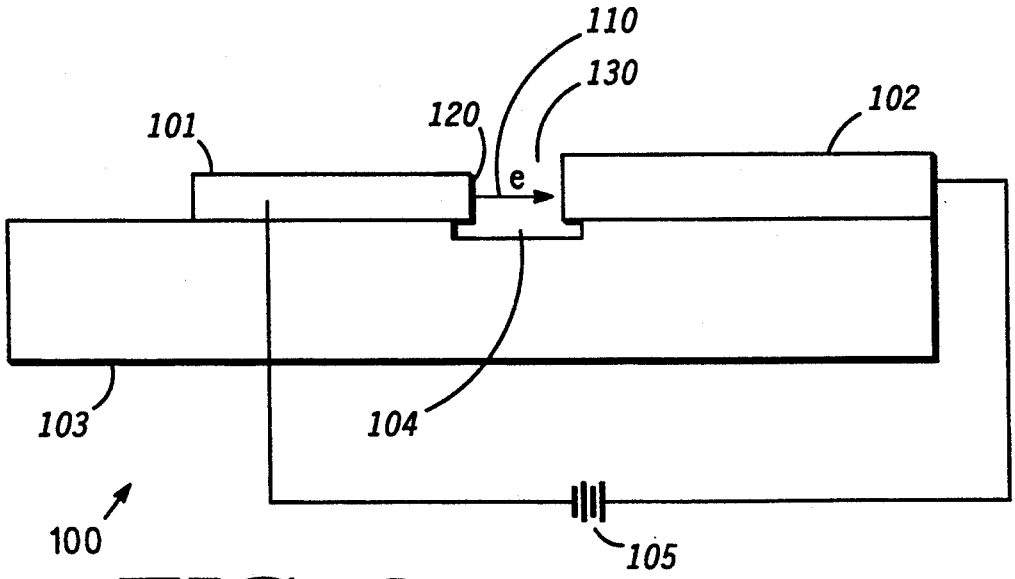
FIG. 3 is a side elevational cross sectional representation of another embodiment of an electron device in accordance with the present invention.

FIG. 3 is a side elevational cross sectional representation of a modified version of electron device 100. In this version, device 100 has a region 104 shown having a depth extending into supporting substrate 103 and a breadth of such extent that a portion of both diamond material electron emitter 101 and anode 102 are unsupported.

Electron device 100, as depicted in FIG. 3, is operated by coupling an externally provided voltage source 105 between diamond material electron emitter 101 and anode 102. The voltage applied therebetween induces electron emission, represented by arrow 110, from emitting surface 120 of electron emitter 101. At least some emitted electrons traverse the extent of interelectrode region 130 to be collected at anode 102.

Consider now that electron emission in device 100 is substantially provided from an emitting surface corresponding to the emitting surface 120 which partially defines the interelectrode region 130. A diamond material electron emitter realized as single crystal (monocrystalline) diamond material presents a substantially single crystallographic orientation such as, for example, a (010) crystallographic orientation. However, for a diamond material electron emitter comprised of polycrystalline diamond material there is a statistical distribution of crystallite facets presented at the emitting surface at least some of which facets will, with finite probability, correspond to a (111) crystallographic orientation. Electron emission is more readily achieved from a diamond material crystallographic surface corresponding to the (111) crystallographic orientation (crystallographic plane) as compared to the diamond material {100} crystallographic planes.

Diamond material provides appreciable electron emission in the presence of electric fields which are approximately two orders of magnitude lower than electric fields required for electron emission via metallic and silicon electron emitters ($5\times10^5$V/cm for diamond vs. $3\times10^7$V/cm for metals and silicon), thus, there is no need to provide features of geometric discontinuity of small radius of curvature as is a requirement of electron emitters of the prior art. This is a significant improvement over the prior art since the difficulty the prior art imposes on device fabrication is eliminated by employing the diamond material electron emitter of the present invention. For example, in order to realize electron emission electron devices of the prior art it has been necessary to provide electron emitters having at least one feature size on the order of 0.05 microns or less; but electron devices constructed in accordance with the electron emitter of the present invention have no feature size requirement imposed.

Figure 4:
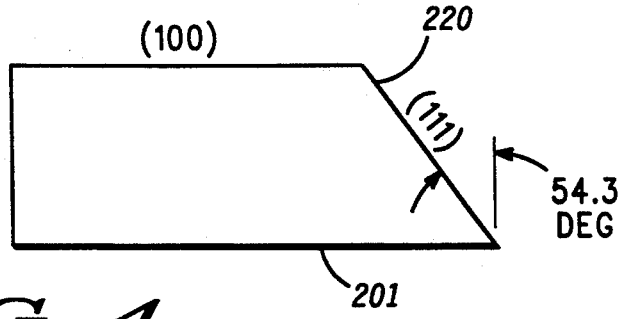
FIG. 4 is a side elevational cross sectional representation of an electron emitter in accordance with the present invention.

FIG. 4 is a side elevational cross sectional representation of a diamond material electron emitter 201, in accordance with the present invention, having an emitting surface 220. For the electron emitter 201 now under consideration the diamond material is crystallographically identified by a crystallographic plane (100) and a crystallographic plane (111). Selective anisotropic etching of diamond films, for example, yields the features depicted in FIG. 4 wherein the preferential (selective) etch provides that the (111) crystallographic plane forms the emitting surface 200.

Figure 5:
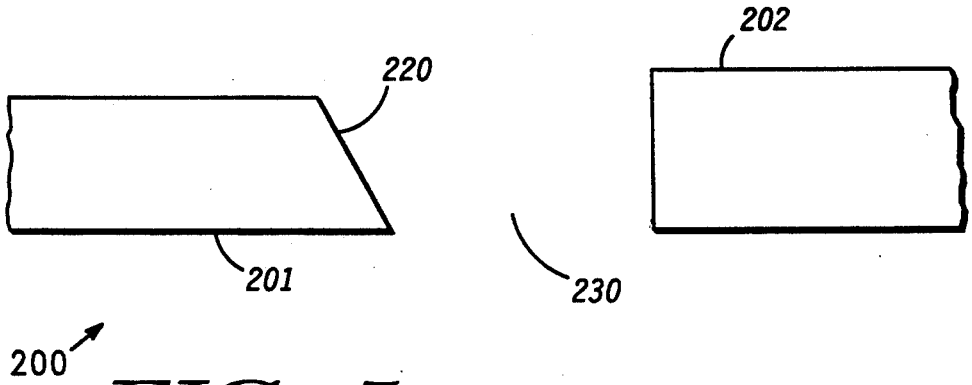
FIG. 5 is a side elevational cross sectional representation of yet another embodiment of an electron device in accordance with the present invention, portions thereof removed.
Figure 6:
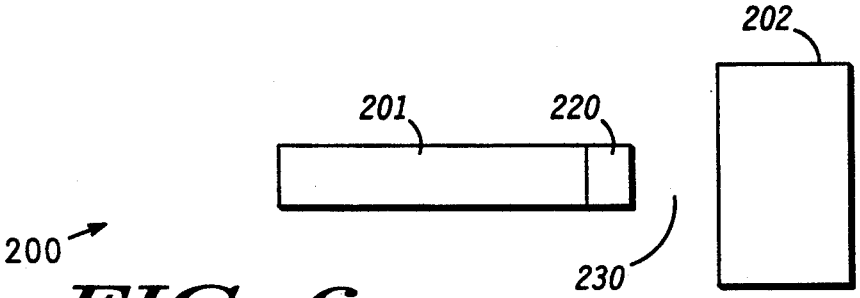
FIG. 6 is a top plan view of the electron device depicted in FIG. 5, portions thereof removed.

FIG. 5 illustrates an electron device 200 including an electron emitter 201 and an an anode 202. Anode 202 is distally disposed with respect to emitting surface 220 of electron emitter 201. Electron emitter 201 and anode 202 define an interelectrode region 230 therebetween. FIG. 6 is a top plan view of electron device 200 illustrating the relative positions of electron emitter 201 and anode 202.

Figure 7:
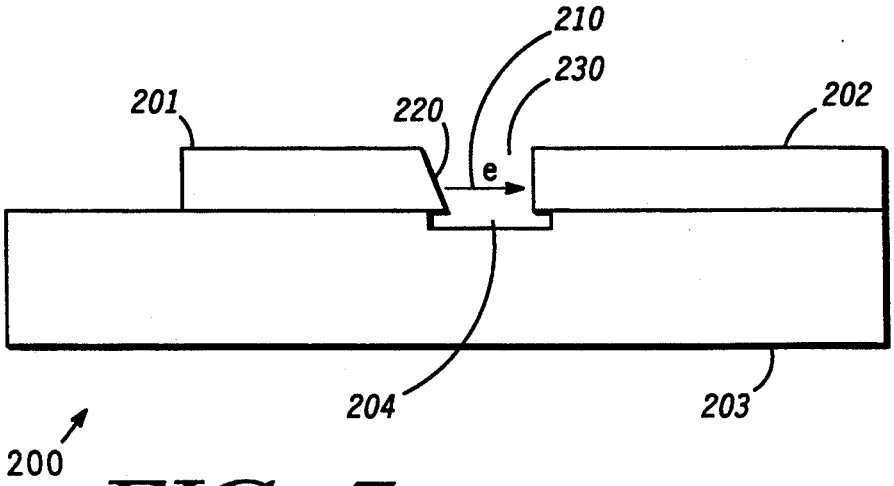
FIG. 7 is a side elevational cross sectional representation of still another embodiment of an electron device in accordance with the present invention.

FIG. 7 is a side elevational cross sectional representation of a modification of electron device 200. In FIG. 7 a diamond material electron emitter 201 having an emitting surface 220 corresponding to the (111) crystallographic plane and an anode 202 both disposed as described previously with reference to FIG. 6 are supported on a supporting substrate 203 having a major surface. A region 204, as described previously with reference to FIG. 3, is formed in the major surface of substrate 203. Application of a voltage (not shown) as described above with reference to FIG. 3 provides for electrons, represented by arrow 210, to be emitted from emitting surface 220 at least some of which will traverse the extent of interelectrode region 230 to be collected at anode 202.

Figure 8:
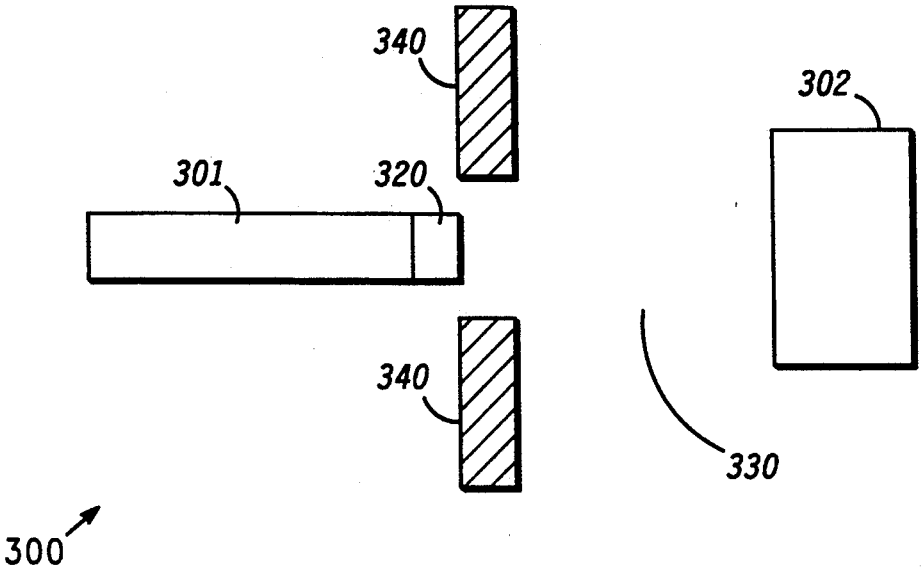
FIG. 8 is a partial top plan view of a further embodiment of an electron device in accordance with the present invention.

Referring now to FIG. 8 there is shown a top plan view of a further embodiment of an electron device 300 in accordance with the present invention. Device 300 includes a diamond material electron emitter 301 having an emitting surface 320, for emitting electrons as described previously with reference to FIGS. 4–6, and an anode 302. Anode 302 is distally disposed with respect to emitting surface 320 and defines an interelectrode region 330 therebetween. A gate electrode 340 is symmetrically disposed and axially displaced with respect to electron emitter 301 and further substantially disposed within interelectrode region 330.

Figure 9:
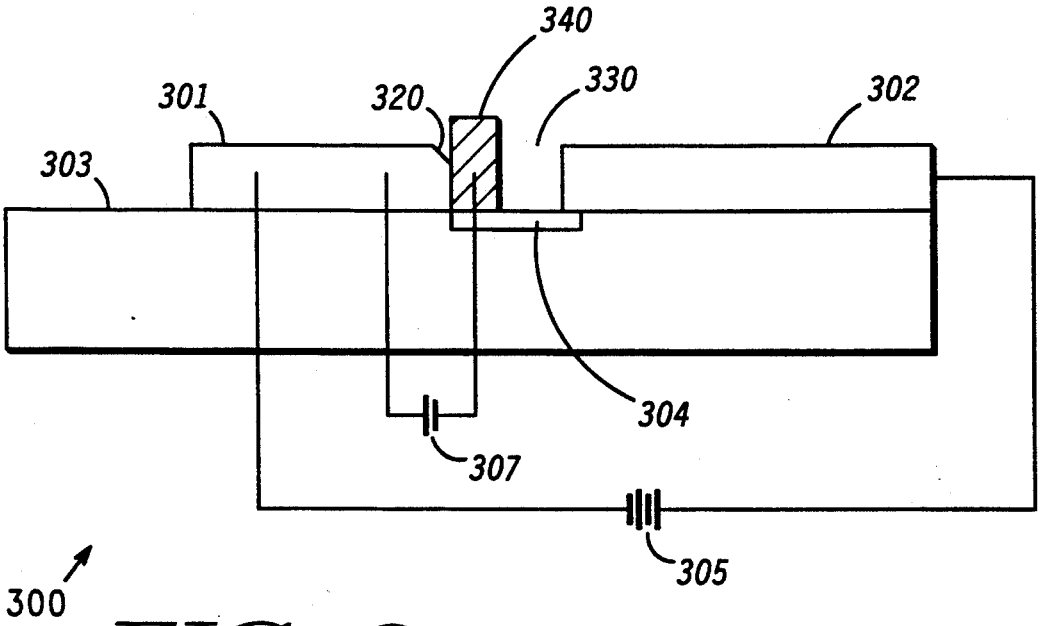
FIG. 9 is a side elevational cross sectional depiction of the electron device depicted in FIG. 8.

FIG. 9 is a side elevational cross sectional representation of electron device 300 further including a supporting substrate 303 having a major surface and a region 304, both as described previously with reference to FIG. 7. Diamond material electron emitter 301 and anode 302 are disposed on the major surface of supporting substrate 303 and gate electrode 340 is disposed therebetween as described with reference to FIG. 7.

To effect operation of device 300, a first externally provided voltage source 305 supplies a first voltage between diamond material electron emitter 301 and anode 302. Upon application of the first voltage electrons are emitted from emitting surface 320 and traverse the extent of interelectrode region 330 to be collected at anode 302. A second externally provided voltage source 307 supplies a second voltage between diamond material electron emitter 301 and gate electrode 340. Application of the second voltage is employed to control the rate of emission of electrons from emitting surface 320. By modulating the second voltage the rate of electron emission is modulated accordingly.

It is anticipated that gate electrode 340 of the electron device of FIGS. 8 and 9 may be advantageously employed in conjunction with the electron device described previously with reference to FIG. 3 wherein a diamond material electron emitter comprised, in one possible realization, of polycrystalline diamond material is employed.

It is one object of the present invention to provide a substantially planar electron emission electron device which does not require small feature sizes on the order of 0.05 microns or less to effect device operation.

It is another object of the present invention to provide a substantially planar electron emission electron device which provides substantial electron emission from diamond material electron emitters by employing induced electric fields on the order of only $5\times10^5$V/cm.

While I have shown and described specific embodiments of the present invention, further modifications and improvements will occur to those skilled in the art. I desire it to be understood, therefore, that this invention is not limited to the particular forms shown and I intend in the append claims to cover all modifications that do not depart from the spirit and scope of this invention.

What is claimed is:

1. An electron device comprising:

a supporting substrate having a major surface;

a diamond material electron emitter disposed on a part of the major surface of the supporting substrate and having an emitting surface for emitting electrons; and an anode, for collecting at least some of any emitted electrons, disposed on a part of the major surface distally with respect to the emitting surface of the diamond material electron emitter and defining an interelectrode region therebetween.

2. An electron device as claimed in claim 1 wherein the diamond material electron emitter includes a diamond film having a crystallographic orientation corresponding to the 100 orientation formed substantially parallel with respect to the major surface of the supporting substrate.

3. An electron device as claimed in claim 1 wherein the diamond material electron emitter is selectively impurity doped semiconductor diamond.

4. An electron device as claimed in claim 1 wherein the emitting surface is substantially defined as a preferred crystallographic orientation.

5. An electron device as claimed in claim 4 wherein the preferred crystallographic orientation is the 111 crystallographic plane.

6. An electron device as claimed in claim 1 wherein the diamond film electron emitter includes polycrystalline diamond material.

7. An electron device as claimed in claim 1 and having a voltage operably applied between the anode and the diamond material electron source such that electrons are emitted from the emitting surface and preferentially collected at the anode.

8. An electron device comprising:

a supporting substrate having a major surface;

a diamond material electron emitter disposed on the major surface of the supporting substrate and having an emitting surface for emitting electrons;

an anode, for collecting at least some of any electrons emitted by the emitting surface of the diamond material electron emitter, disposed on the major surface of the supporting substrate distally with respect to the emitting surface of the diamond material electron emitter and defining an interelectrode region between the anode and the emitting surface of the diamond material electron emitter; and a gate electrode disposed on the major surface of the supporting substrate and substantially symmetrically and axially displaced about the diamond material electron emitter and substantially in the interelectrode region.

9. An electron device as claimed in claim 8 wherein the diamond material electron emitter includes a diamond film 30 having a crystallographic orientation corresponding to the 100 orientation formed substantially parallel with respect to the major surface of the supporting substrate.

10. An electron device as claimed in claim 8 wherein the diamond material electron emitter is selectively impurity doped semiconductor diamond.

11. An electron device as claimed in claim 8 wherein the emitting surface is substantially defined as a preferred crystallographic orientation.

12. An electron device as claimed in claim 11 wherein the preferred crystallographic orientation is the 111 crystallographic plane.

13. An electron device as claimed in claim 8 wherein the diamond film electron emitter includes polycrystalline diamond material.

14. An electron device as claimed in claim 8 and having a first voltage operably applied between the anode and the diamond material electron emitter and having a second voltage operably applied between the gate electrode and the diamond material electron emitter such that the rate of electron emission from the emitting surface of the diamond material electron emitter occurring as a result of the first voltage is modulated by modulating the second voltage.

* * * * *